United States Patent [19]

Hayashi et al.

[11] 4,396,351

[45] Aug. 2, 1983

[54] ENGINE COOLING FAN

[75] Inventors: Masaharu Hayashi, Toyota; Shunzo Tsuchikawa, Ichinomiya; Takanobu Hori, Toyota, all of Japan

[73] Assignee: Aisin Seiki Kabushiki Kaisha, Aichi, Japan

[21] Appl. No.: 218,072

[22] Filed: Dec. 19, 1980

[30] Foreign Application Priority Data

Dec. 21, 1979 [JP] Japan ..... 54-167005

[51] Int. Cl.[3] ..... F01D 5/20; F01D 1/16; F01D 7/10

[52] U.S. Cl. ..... 415/172 A; 415/182; 415/236 A; 415/241 A; 415/189; 415/41.49

[58] Field of Search ..... 415/182, 172 A; 416/236 R, 236 A, 189 R, 192; 123/41.49

[56] References Cited

U.S. PATENT DOCUMENTS

| | | | |
|---|---|---|---|
| 3,189,982 | 6/1965 | Merz | 416/192 |
| 3,842,902 | 10/1974 | Poslosny | 416/192 |
| 4,128,363 | 12/1978 | Fujikake et al. | 416/192 |
| 4,189,281 | 2/1980 | Katagirl et al. | 123/41.49 X |
| 4,213,426 | 7/1980 | Longhouse | 123/41.49 |

FOREIGN PATENT DOCUMENTS

| | | | |
|---|---|---|---|
| 1628257 | 5/1970 | Fed. Rep. of Germany | 416/236 A |
| 2850658 | 5/1979 | Fed. Rep. of Germany | 416/236 A |

*Primary Examiner*—Harvey C. Hornsby
*Assistant Examiner*—Shewen Bian
*Attorney, Agent, or Firm*—Oblon, Fisher, Spivak, McClelland & Maier

[57] ABSTRACT

An engine cooling fan driven by an engine and located in a shroud extending from a radiator to the engine including a hub having a cylindrical rear end portion for mounting the fan on the engine, a plurality of blades provided on the hub and a ring fixedly provided on tip portions of the blades and extending in an axial direction so as to fully encircle the tips of the blades and forming a radial clearance between the shroud and the ring, the ring including a rear end portion positioned axially rearwardly of the cylindrical rear end of the shroud and extending radially outwardly of the shroud thereby restricting air flow from the rear side of the fan into the radial clearance formed between the shroud and the ring.

2 Claims, 5 Drawing Figures

ENGINE COOLING FAN

BACKGROUND OF THE INVENTION

1. Field of the Invention

This invention relates to an engine cooling fan for an automotive vehicle and more particularly to a fan driven by an engine and located in a shroud extending from a radiator to the engine.

2. Description of the Prior Art

In an engine cooling system for an automotive vehicle, a fan driven by an engine is often located in a shroud extending from a radiator to the engine to increase the quantity of radiator cooling air flow caused by operation of the fan. In such case, a clearance must be provided between tips of fan-blades and the shroud to avoid interference of the shroud with rotation of the fan, thereby causing objectionable recirculating air flow in the clearance.

Since the recirculating air flow affects the radiator cooling air flow, a ring surrounding the fan is fixedly provided on the tips of the fan blades to form a labyrinth seal in the clearance. The ring and the shroud are preferably provided with portions opposing each other in the axial direction of fan so as to increase the sealing effect in the labyrinth seal. The ring of the fan is also effective in suppressing the generation of a vortex.

However, in such prior art, the portion of the shroud opposing the corresponding portion of the ring of the fan is formed on a rear end thereof as an inwardly extending flange, while the portion of the ring of the fan opposing the flange of the shroud is located on the front side or the rear side of the flange of the shroud. The provision of the flange on the rear end of the shroud increases the manufacturing cost. In addition, when a portion of the ring of the fan is located on the front side of the flange of the shroud, the shroud is required to be of a divisable construction for assembling the vehicle in the plant thereby increasing the manufacturing cost.

SUMMARY OF THE INVENTION

One object of this invention is to provide a novel and improved fan with a ring for restraining the recirculating air flow in a clearance between the fan periphery and a shroud wherein the shroud has no flange on the rear end thereof and constitutes a single piece.

Another object of the invention is to provide a fan which can be manufactured at low cost.

A further object of the invention is to provide a fan which allows for a large quantity of radiator cooling air flow while being of a relatively small size.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
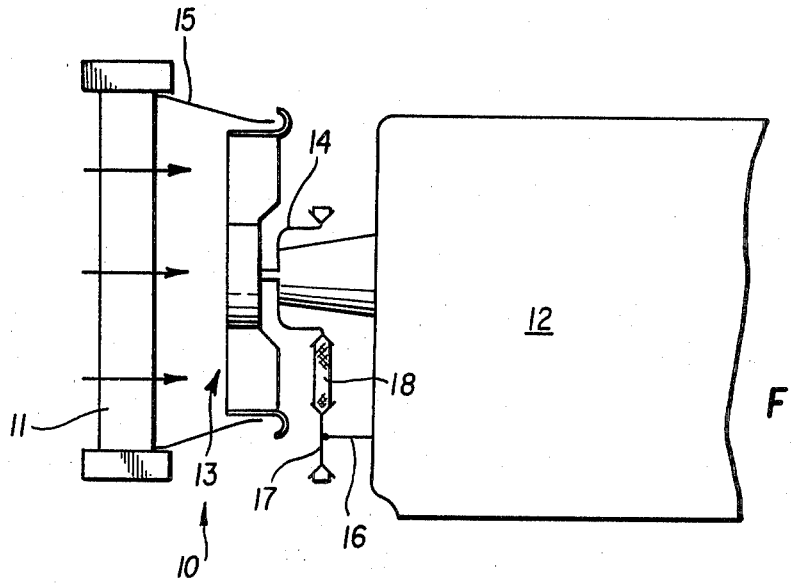
FIG. 1 is a schematic diagram of an engine cooling system for an automotive vehicle.

Referring now to FIG. 1, there is schematically shown an engine cooling system 10 for an automotive vehicle. Engine cooling system 10 includes a radiator 11 hydraulically connected to a water jacket of an engine 12 and a fan 13 according to this invention.

Fan 13 is secured to a driven pulley 14 mounted on engine 12 and is located in a shroud 15 extending from radiator 11 to engine 12. Pulley 14 is drivingly connected to a driving shaft 16 of engine 12 by a driving pulley 17 on driving shaft 16 and a belt 18 disposed between pulleys 14 and 17 thereby driving fan 13 by engine 12 to create the radiator cooling air flow which is shown in FIG. 1 by the arrows.

Figure 2:
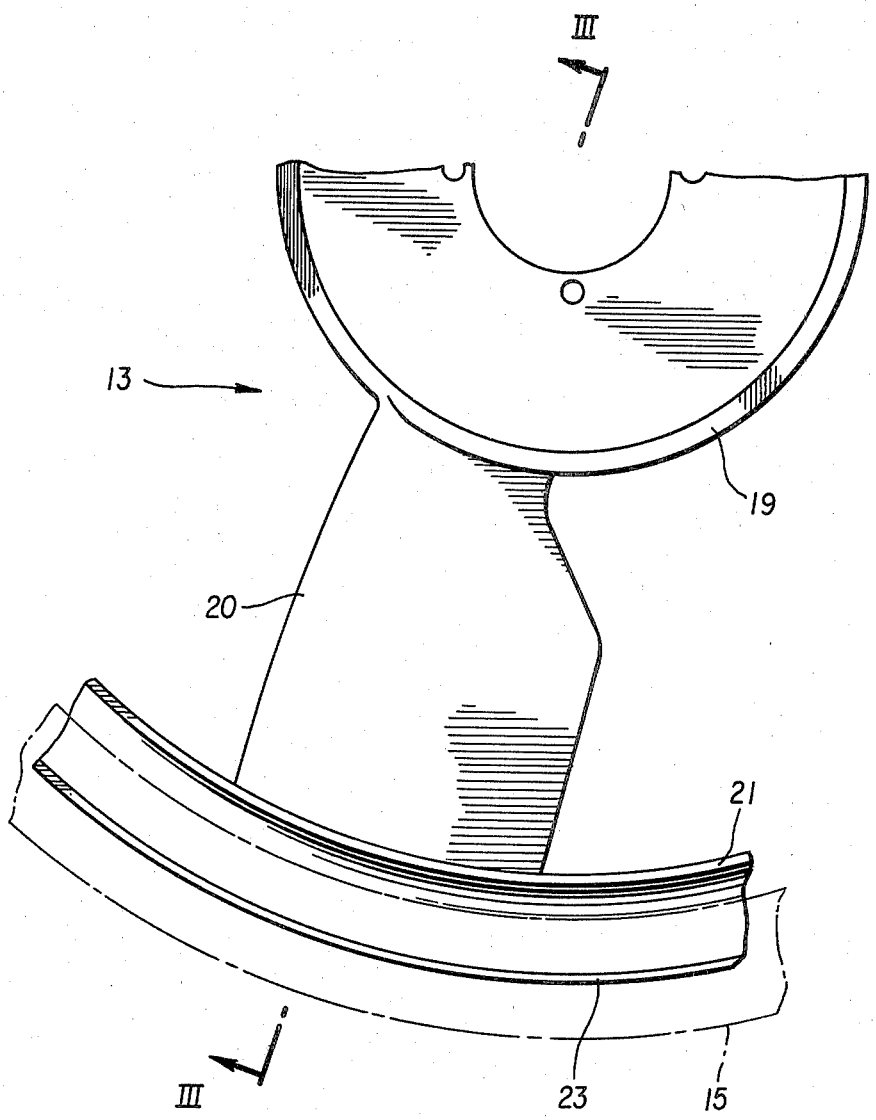
FIG. 2 is a fragmentary front view of a first embodiment of the fan according to this invention.
Figure 3:
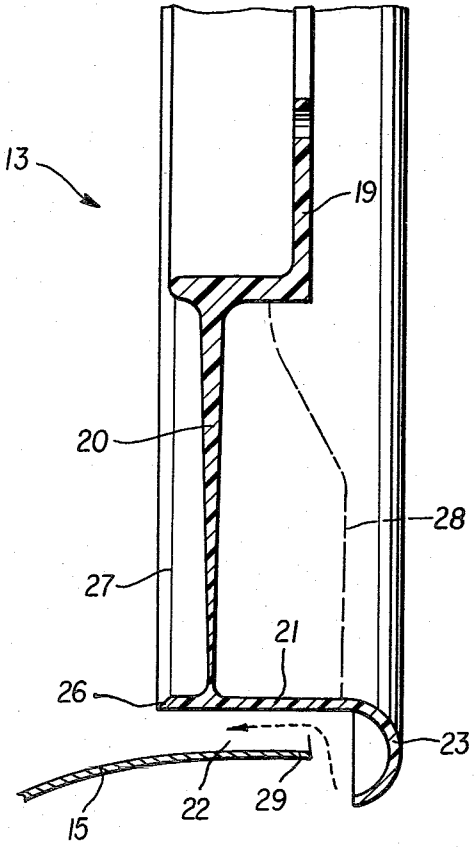
FIG. 3 is a cross sectional view taken along line III—III in FIG. 2.

Referring to FIGS. 2 and 3, fan 13 includes a hub 19 to be secured to pulley 14 and a plurality of blades 20 provided on the hub 19 as well known. Fan 13 further includes an encircling ring 21 positioned on the tips of blades 20 to reduce the quantity of recirculating air flow, which is shown in FIG. 3 by a dotted arrow, in a clearance 22 between fan 13 and shroud 15. Hub 19, blades 20 and ring 21 are made of synthetic resin and are formed of a single piece.

Figure 5:
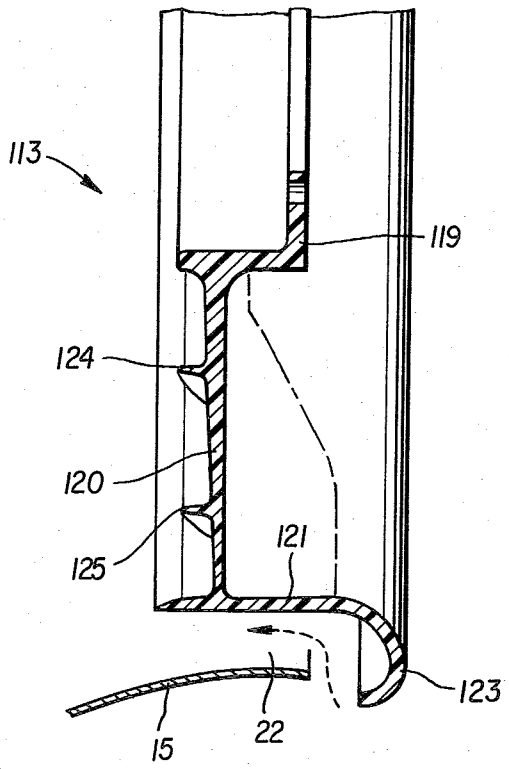
FIG. 5 is a cross sectional view taken along line V—V in FIG. 4.

Ring 21 includes a front end 26 positioned axially in front of a front edge 27 of each blade 20 and a rear end 23 positioned axially outside of shroud 15. The rear end 29 of shroud 15 has no flange as shown in FIGS. 1 and 3, while rear end 23 of ring 21 is rounded in a convex shape so as to form a U-shape toward engine 12 thereby efficiently restricting flow of air from the rear side of fan 13 into clearance 22 and efficiently suppressing the generation of a vortex around the periphery of fan 13. The outermost diameter portion of the rear end 23 is dimensionally greater than the diameter of the rear end 29 of shroud 15. As shown in FIGS. 3 and 5, the ring 21 is enclosed by shroud 15 from front end 26 to at least a substantially mid-portion of ring 21.

In assembling the vehicle, the rear end 23 of ring 21 has no obstruction upon inserting fan 13 mounted on engine 12 into shroud 15 formed of a single or unitary piece. The one piece construction of shroud 15 and the provision for no flange on shroud 15 are convenient in decreasing the manufacturing cost.

Figure 4:
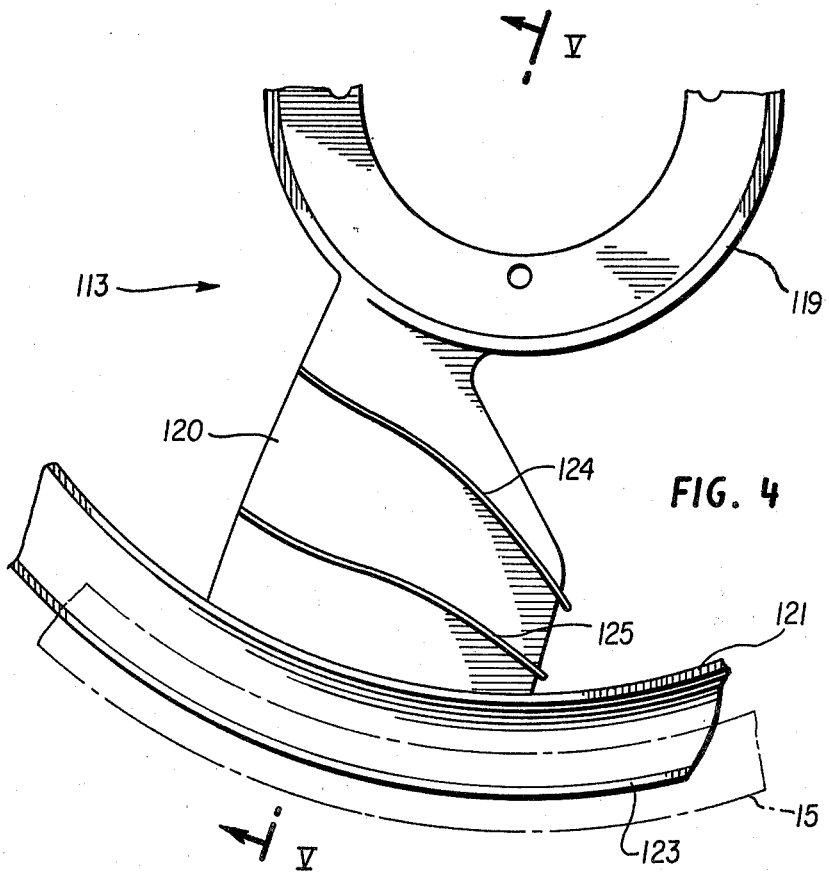
FIG. 4 is a view similar to FIG. 2, but showing a second embodiment of the fan according to the invention.

Referring to FIGS. 4 and 5, there is shown a second embodiment of the fan according to the present invention. Fan 113 includes a hub 119, a plurality of blades 120 on hub 119, a ring 121 including a rear end 123 for restricting recirculating air flow, and a pair of guiding fins 124 and 125 on the front face of each blade 120. Guiding fins 124 and 125 are effective in increasing the quantity of radiator cooling air flow and the efficiency of the fan under such conditions that the pressure difference between both sides of fan 113 is relatively small. Ring 121 is effective in increasing the quantity of radiator cooling air flow and the efficiency of the fan under such conditions that the pressure difference between both sides of fan 113 is relatively large. The provisions of guiding fins is specifically disclosed in U.S. Pat. No. 4,128,363 granted on Dec. 5, 1978, to Fujikade et al.

Obviously, many modifications and variations of the invention are possible in light of the above. It is therefore to be understood that within the scope of the appended claims, the invention may be practicable otherwise than as specifically described herein.

What is claimed as new and desired to be secured by Letters Patent of the United States is:

1. An engine cooling fan driven by an engine and located in a shroud having a cylindrical rear end and extending from a radiator to said engine, comprising:

a hub having a cylindrical rear end portion for mounting said fan on said engine, a plurality of blades provided on said hub, and a ring fixedly provided on tip portions of said blades and extending in an axial direction so as to fully encircle said tip portions of said blades and forming a radial clearance between said shroud and said ring, said ring including a front end portion, a rear end portion positioned axially rearwardly of said cylindrical rear end of said shroud and extending radially outwardly of said shroud, said hub, said blades and said ring further comprise a one piece member which comprises synthetic resin and said rear end portion of said ring is rounded in shape and convex toward said engine so as to form a U-shape to effectively restrict the flow from the rear side of said fan into said radial clearance formed between said shroud and said ring, the outermost diameter portion of which is dimensionally greater than the diameter of said rear end of said shroud, said ring extending axially along an outer diameter portion of the blades from said front end portion to a radially outermost portion of said rear end portion and wherein said ring is enclosed by said shroud from said front end portion of said ring to at least a mid-portion of said ring.

2. An engine cooling fan as set forth in claim 1, said blades further comprising guiding fin members formed on a front face thereof.

* * * * *